US011118403B1

(12) United States Patent
Feddema et al.

(10) Patent No.: US 11,118,403 B1
(45) Date of Patent: Sep. 14, 2021

(54) ENERGIZED RING VALVE

(71) Applicant: SANVEAN TECHNOLOGIES LLC, Katy, TX (US)

(72) Inventors: Chad Feddema, Conroe, TX (US); Stephen Jones, Cypress, TX (US); Junichi Sugiura, Bristol (GB)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 23 days.

(21) Appl. No.: 16/816,544

(22) Filed: Mar. 12, 2020

(51) Int. Cl.

| | |
|---|---|
| ***E21B 7/04*** | (2006.01) |
| ***E21B 7/08*** | (2006.01) |
| ***E21B 21/10*** | (2006.01) |
| ***E21B 21/08*** | (2006.01) |
| ***E21B 47/18*** | (2012.01) |
| ***E21B 47/06*** | (2012.01) |
| ***E21B 34/08*** | (2006.01) |
| ***E21B 7/06*** | (2006.01) |

(52) U.S. Cl.
CPC ..... *E21B 7/04* (2013.01); *E21B 7/06* (2013.01); *E21B 21/08* (2013.01); *E21B 21/10* (2013.01); *E21B 34/08* (2013.01); *E21B 47/06* (2013.01); *E21B 47/18* (2013.01)

(58) Field of Classification Search
CPC ... E21B 7/04; E21B 7/06; E21B 21/10; E21B 34/08; E21B 47/18; E21B 21/08; E21B 47/06
See application file for complete search history.

(56) References Cited

U.S. PATENT DOCUMENTS

| | | | | |
|---|---|---|---|---|
| 10,422,184 | B1 * | 9/2019 | Feddema | E21B 7/06 |
| 2015/0107902 | A1 * | 4/2015 | Downton | E21B 47/024 175/45 |
| 2016/0060960 | A1 * | 3/2016 | Parkin | E21B 17/10 175/24 |
| 2017/0198525 | A1 * | 7/2017 | Feddema | E21B 47/24 |

* cited by examiner

*Primary Examiner* — Brad Harcourt
(74) *Attorney, Agent, or Firm* — Locklar PLLC

(57) ABSTRACT

A steering tool for use in a wellbore may comprise a tool housing having a bore and containing a steering cylinder, a steering blade, and a ring valve configured to control fluid flow to the steering cylinder. The ring valve may include a gear housing, a manifold fluidly coupling the bore to the steering cylinder, a valve seat, a valve carrier circumferentially supporting the valve seat, an upper valve housing mechanically coupled to the gear housing, a lower valve housing mechanically coupled to the upper valve housing and reciprocably coupled to the valve carrier, and at least one biasing means positioned between the valve carrier and the lower valve housing and configured to urge the valve carrier away from the lower valve housing.

20 Claims, 11 Drawing Sheets

ENERGIZED RING VALVE

TECHNICAL FIELD/FIELD OF THE DISCLOSURE

The present disclosure relates generally to downhole drilling tools, and specifically to an energized ring valve for use therein.

BACKGROUND OF THE DISCLOSURE

When drilling a hydrocarbon production well, it may be desirable to maintain a specific drilling direction. For this reason, steerable systems may be utilized to control the direction of propagation of the wellbore. Typical steerable systems may include a rotating section that includes the drill bit and any associated shafts, and a non-rotating section that remains substantially non-rotating relative to the surrounding formation.

Steerable drilling systems are often classified as either "point-the-bit" or "push-the-bit" systems. In point-the-bit systems, the rotational axis of the drill bit is deviated from the longitudinal axis of the drill string in the direction of the wellbore. The wellbore may be propagated in accordance with a three-point geometry defined by upper and lower points of contact between the drill string and the wellbore, defined as touch points, and the drill bit. The angle of deviation of the drill bit axis, coupled with the distance between the drill bit and the lower touch point, results in a non-collinear condition that generates a curved wellbore as the drill bit progresses through the formation.

SUMMARY

Some embodiments of a steering tool for use in a wellbore may comprise a tool housing coupled to and positioned about a tubular mandrel having a bore therethrough, the tool housing able to rotate about the mandrel; a steering cylinder formed in the housing, wherein the steering cylinder may be fluidly coupled to a first steering port and contains fluid at a steering cylinder pressure; a steering blade coupled to the housing, the steering blade at least partially positioned within the steering cylinder, the steering blade extendable by an extension force to contact a wellbore, wherein the extension force may be caused by a differential pressure between the steering cylinder pressure and a fluid pressure in the wellbore; and a ring valve. The ring valve may include a gear housing; a manifold mechanically coupled to the tool housing, a valve seat, a valve carrier mechanically coupled to the valve seat and having upper and lower valve carrier surfaces, an upper valve housing mechanically coupled to the gear housing; a lower valve housing mechanically coupled to the upper valve housing and reciprocably coupled to the valve carrier; and at least one biasing means positioned between the valve carrier and the lower valve housing and configured to urge the valve carrier away from the lower valve housing.

The manifold may include an upper manifold surface having at least one manifold orifice therein. The manifold orifice may provide fluid communication between the upper manifold surface and the first steering port and may fluidly couple the bore to the steering cylinder. The valve seat may have a lower ring surface positioned in abutment with the upper manifold surface. The valve seat may be rotatable relative to the manifold and the lower ring surface may be configured such that rotation of the valve seat relative to the manifold selectively opens and closes the at least one manifold orifice. The lower valve carrier surface may circumferentially support the valve seat.

The valve carrier may have an upper valve carrier surface and the lower valve housing may have a biasing surface configured to bear on the upper valve carrier surface. The biasing surface may include at least two receptacles that are each configured to receive a biasing means. The biasing surface may include at least sixteen receptacles and the tool may include twelve biasing means each partially received in a receptacle and positioned between the valve carrier and the lower valve housing. The tool further may include four containment pins each partially received in a receptacle and positioned between the valve carrier and the lower valve housing. The receptacles may be evenly spaced about the circumference of the steering tool. Each biasing means may be selected from the group consisting of: coil springs, Belleville washers, elastomeric members, and leaf or bow springs. The steering tool may further include a seal, an O-ring, a snap ring, and a thrust bearing between the lower valve housing and the upper valve housing.

In some embodiments a method for drilling a well may comprise the steps of: a) providing a drill string that includes a downhole steering tool, b) using the downhole steering tool to steer while drilling, and c) using the pressure sensor to measure pressure in the steering port and using the measured pressure to adjust operation of the downhole steering tool.

The downhole steering tool may comprise a housing coupled to and positioned about a tubular mandrel, the housing able to rotate about the mandrel, the housing having a plurality of steering cylinders formed therein, each steering cylinder fluidly coupled to a respective steering port; a plurality of steering blades coupled to the housing, each steering blade at least partially disposed within a respective steering cylinder, each steering blade extendable by a differential pressure between a respective steering cylinder pressure and a pressure in the wellbore surrounding the downhole tool, the differential pressure caused by fluid pressure in a respective steering port; a pressure sensor in at least one steering port; and a ring valve, the ring valve including a gear housing and a manifold mechanically coupled to the tool housing. The manifold may include an upper manifold surface having at least one manifold orifice therein and the manifold orifice may provide fluid communication between the upper manifold surface and steering port so as to fluidly couple the bore to the steering cylinder.

The ring valve may further include a valve seat, the valve seat having a lower ring surface positioned in abutment with the upper manifold surface. The valve seat may be rotatable relative to the manifold and the lower ring surface may be configured such that rotation of the valve seat relative to the manifold selectively opens and closes at least one manifold orifice. The ring valve may further include a valve carrier mechanically coupled to the valve seat and having upper and lower valve carrier surfaces. The lower valve carrier surface may circumferentially support the valve seat. The ring valve may further include an upper valve housing mechanically coupled to the gear housing and a lower valve housing mechanically coupled to the upper valve housing and reciprocably coupled to the valve carrier.

The ring valve may further include at least one biasing means positioned between the valve carrier and the lower valve housing and configured to urge the valve carrier away from the lower valve housing.

In some embodiments, the downhole steering tool may include a pressure sensor in each steering port and the method may include the steps of d) using the ring valve to cause extension of the steering blades by controlling pressure in each steering port; and e) using the pressure measured in step c) as feedback to control the extension of the steering blades in step d). Additionally or alternatively, the method may include the steps of d) using the ring valve to generate pressure pulse shapes for mud-pulse telemetry and e) using the pressure data measured in step c) as feedback to control the generation of pressure pulses in step d). Additionally or alternatively, the method may include the step of d) using the pressure data measured in step c) to sense mud pulses arriving at the downhole tool. Additionally or alternatively, the method may include the step of d) using the pressure data measured in step c) to detect or diagnose a malfunction in the ring valve.

The downhole steering tool may include a pressure sensor in each steering port and the method may further include using the pressure measured in step c) to execute at least two of: i) a steering feedback step comprising ia) using the ring valve to cause extension of the steering blades by controlling pressure in each steering port and ib) using the pressure measured in step c) as feedback to control the extension of the steering blades in step ia); ii) a signaling feedback step comprising iia) using the ring valve to generate pressure pulse shapes for mud-pulse telemetry; and iib) using the pressure data measured in step c) as feedback to control the generation of pressure pulses in step iia); iii) a sensing step comprising using the pressure data measured in step c) to sense mud pulses arriving at the downhole tool; and iv) a diagnostic step comprising using the pressure data measured in step c) to detect or diagnose a malfunction in the ring valve.

Each of steps i), ii), iii) and iv) may be carried out at least once during a single drilling operation. Step ib) may comprise adjusting the position of the valve seat relative to the manifold so as to adjust a fluid flow through at least one manifold orifice. Step iib) may comprise changing the valve movement velocity. Step iv) may trigger a jam mitigation step in which the ring valve opens and closes at least one manifold orifice.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
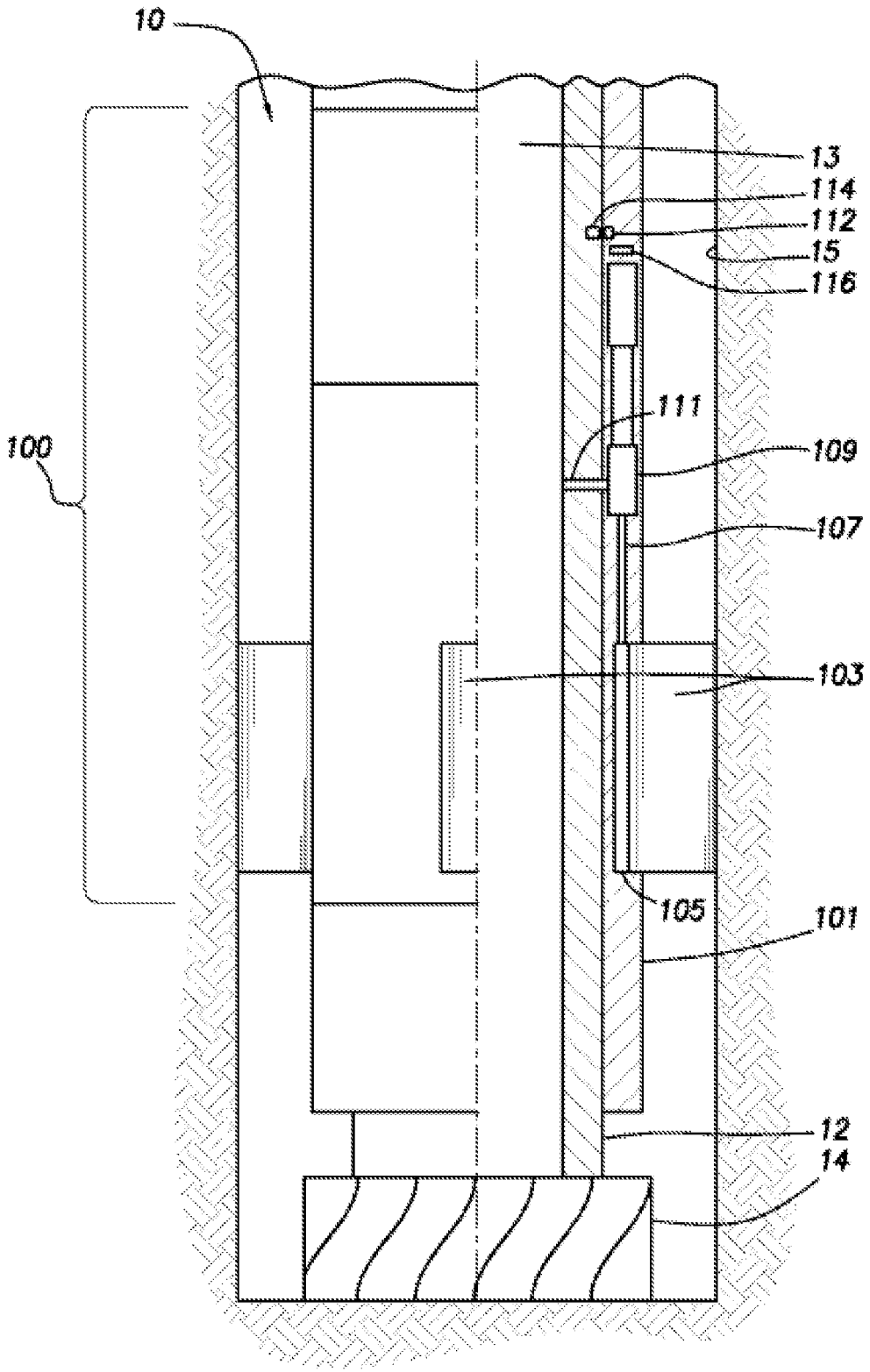
FIG. 1 is a schematic illustration of a downhole steering tool in partial cross section consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, a downhole steering tool 100 may be included as part of a drill string 10. In some embodiments, downhole steering tool 100 may be included as part of a bottom hole assembly (BHA) of drill string 10. In some embodiments, downhole steering tool 100 may be positioned about a mandrel 12 that is part of drill string 10. Mandrel 12 may have a central bore 13 therethrough and may be coupled to a drill bit 14 and adapted to provide rotational force thereto so as to drill a wellbore 15. In some embodiments, mandrel 12 may be coupled to drill string 10 such that rotation of drill string 10 from the surface by, for example and without limitation, a rotary table or top drive, causes rotation of mandrel 12. In some embodiments, mandrel 12 may be coupled to a downhole motor such as a mud motor or downhole turbine (not shown) to provide a rotation force.

Downhole steering tool 100 may include a housing 101. In some embodiments, housing 101 may be tubular or generally tubular. Housing 101 may be positioned about mandrel 12 and may be rotatably coupled thereto such that mandrel 12 may rotate independently of housing 101. In some embodiments, for example and without limitation, one or more bearings may be positioned between housing 101 and mandrel 12. Although shown as a single piece, one having ordinary skill in the art with the benefit of this disclosure will understand that housing 101 may be formed from one or more pieces.

In some embodiments, housing 101 may rotate at a speed that is less than the rotation rate of the drill bit 14 and mandrel 12. In some embodiments, housing 101 may rotate at a speed that is less than the rotation speed of mandrel 12. For example and without limitation, housing 101 may rotate at a speed at least 50 RPM slower than mandrel 12. For example and without limitation, in an instance where mandrel 12 rotates at 51 RPM, housing 101 may rotate at 1 RPM or less. In some embodiments, housing 101 may be substantially non-rotating, and may rotate at a speed that is less than a percentage of the rotation speed of mandrel 12. For example and without limitation, housing 101 may rotate at a speed lower than 50% of the speed of mandrel 12. In some embodiments, housing 101, by not rotating substantially, may maintain a toolface orientation independent of rotation of drill string 10.

In some embodiments, downhole steering tool 100 may include one or more steering blades 103. Steering blades 103 may be positioned about a periphery of housing 101. Steering blades 103 may be radially extendible to contact wellbore 15. In some embodiments, steering blades 103 may be at least partially positioned within corresponding steering cylinders 105 and may be sealed thereto. Steering cylinders 105 may be formed in housing 101. Steering cylinders 105 may, in some embodiments, be cavities formed in housing 101 into which steering blades 103 are at least partially positioned such that fluid may flow into steering cylinders 105 and apply fluid pressure to steering blades 103. Fluid pressure within each steering cylinder 105, defining a steering cylinder pressure, may increase above fluid pressure in the surrounding wellbore 15, defining a wellbore pressure, thereby causing a differential pressure across the steering blade 103 positioned therein. The differential pressure may exert an extension force on steering blade 103. The extension force on steering blade 103 may urge steering blade 103 into an extended position. When positioned within wellbore 15, the extension force may cause steering blade 103 to contact the wall of wellbore 15. In some embodiments, steering blade 103 may, for example and without limitation, at least partially prevent or retard rotation of housing 101 to, for example and without limitation, less than 20 revolutions per hour.

In some embodiments, fluid may be supplied to each steering cylinder 105 through a steering port 107 formed in housing 101. The fluid in each steering port 107 may be controlled by one or more adjustable orifices 109. Fluids may include, but are not limited to, drilling mud, such as oil-based drilling mud or water-based drilling mud, air, mist, foam, water, oil, including gear oil, hydraulic fluid or other fluids within wellbore 15. Adjustable orifices 109 may control fluid flow between an interior of mandrel 12 and steering ports 107. In some embodiments, each steering cylinder 105 is controlled by an adjustable orifice 109. In some embodiments, one or more steering blades 103 may be aligned about downhole steering tool 100 and may be controlled by the same adjustable orifice 109. As used herein, "adjustable orifice" includes any valve or mechanism having an adjustable flow rate or restriction to flow.

Fluid may be supplied to each adjustable orifice 109 from bore 13 of mandrel 12. Adjustable orifices 109 may be in fluid communication with bore 13 of mandrel 12. In some embodiments, for example and without limitation, one or more apertures 111 may be formed in mandrel 12 and fluidly coupled to each adjustable orifice 109, thereby allowing fluid to flow to each adjustable orifice 109 as mandrel 12 rotates relative to housing 101. In some embodiments, as further discussed herein below, a diverter may be utilized.

Figure 2A:
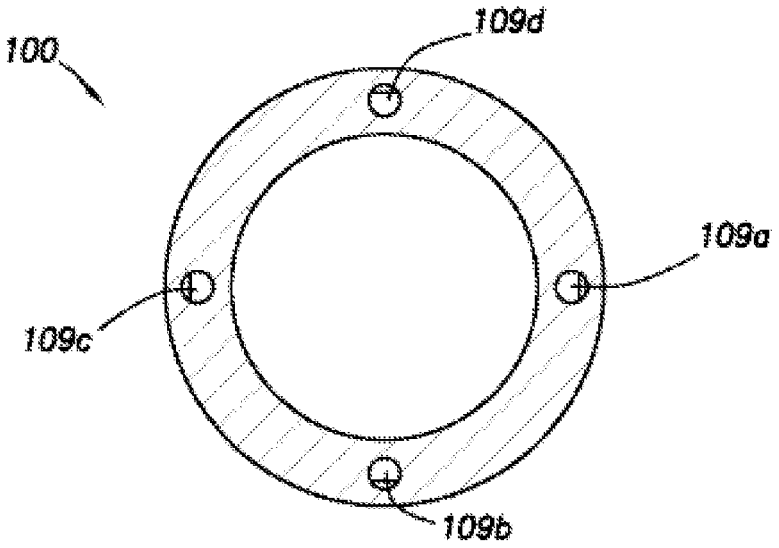
FIG. 2A is a schematic partial cross section illustrating one configuration of the downhole steering tool of FIG. 1.
Figure 2B:
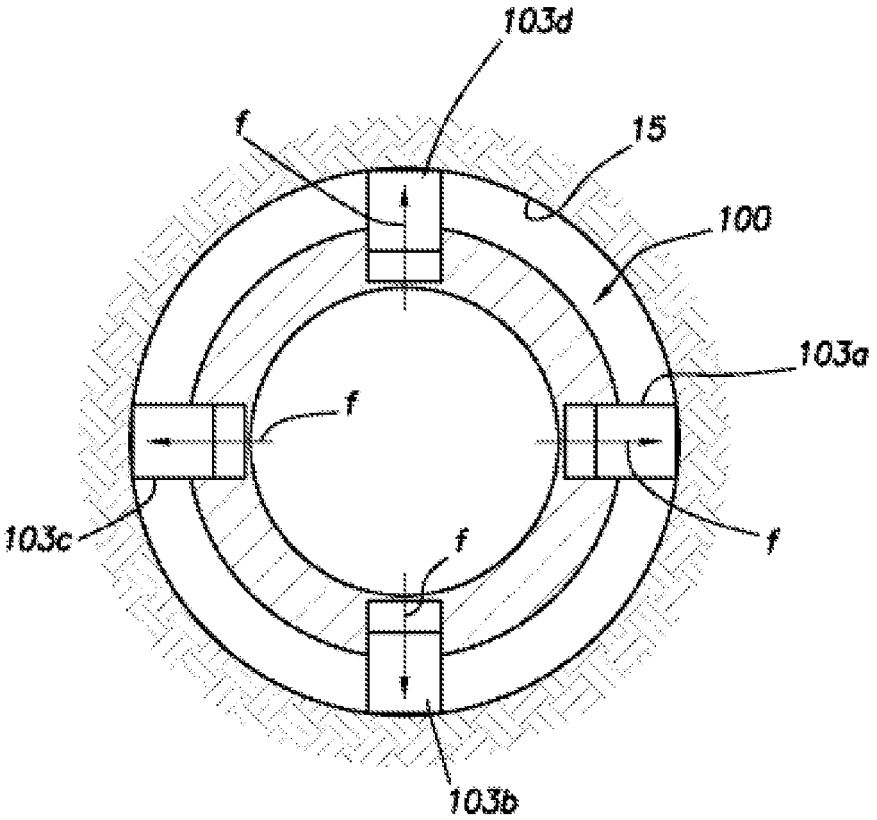
FIG. 2B is a schematic cross section of the downhole steering tool of FIG. 1 in a centralizing position in a wellbore.

In some embodiments, adjustable orifices 109 may be reconfigurable between an open position and a partially open position. In some embodiments, adjustable orifices 109 may further have a closed position. In the partially open position, the amount of fluid that may pass through an adjustable orifice 109 into the corresponding steering cylinder 105 is less than the amount that may pass through in the fully open position. During certain operations, for instance to centralize downhole steering tool 100 within wellbore 15, as depicted schematically and without limitation as to structure in FIG. 2A, each adjustable orifice 109*a-d* may remain in the partially open position. In some embodiments, the partially open position may allow between 0% and 50% of the flow of the opened position, between 10% and 40% of the flow of the opened position, or between 25% and 35% of the opened position. Each adjustable orifice 109 may be in the open, partially open, or closed configuration independently of the other adjustable orifices 109. When adjustable orifices 109 are all in the same configuration, each steering blade 103*a-d* may receive a substantially equal differential pressure thereacross and may be extended to contact wellbore 15 with approximately equal extension force, shown graphically as arrows depicting first extension force f Steering blades 103*a-d* may thus centralize downhole steering tool 100 within wellbore 15.

Figure 3A:
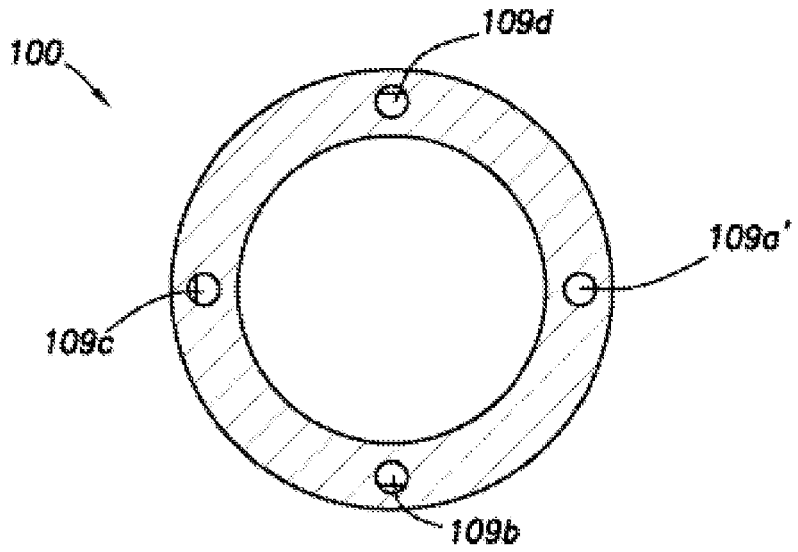
FIG. 3A is a schematic partial cross section illustrating another configuration of the downhole steering tool of FIG. 1.
Figure 3B:
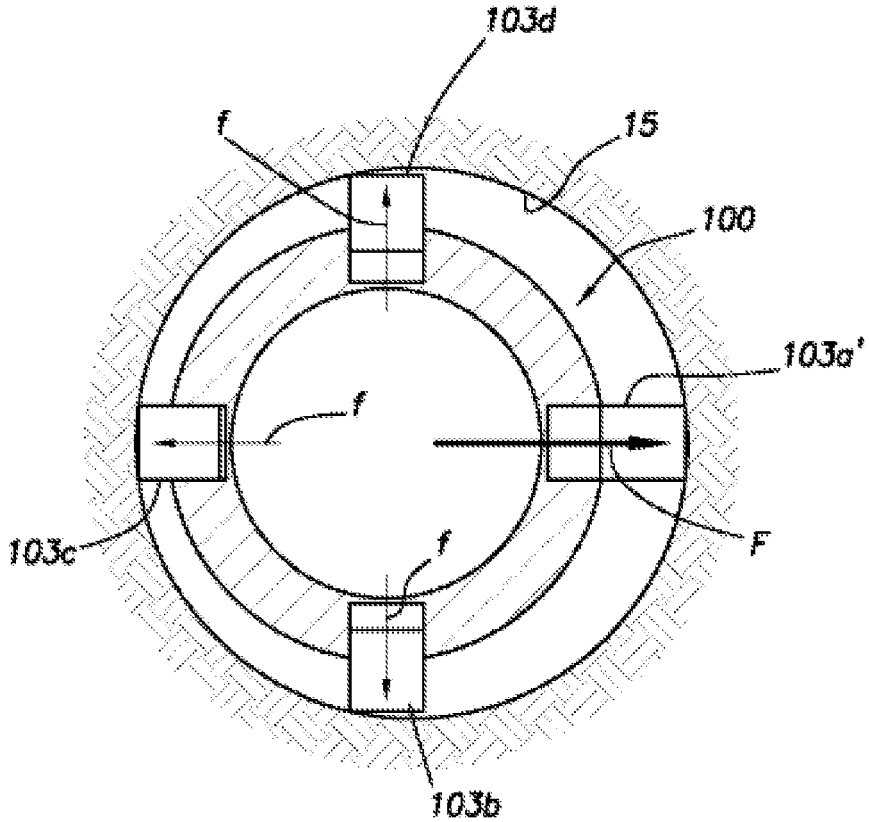
FIG. 3B is a schematic cross section of the downhole steering tool of FIG. 1 in a steering position in a wellbore.

When a steering input is desired, one or more adjustable orifices (depicted as adjustable orifice 109*a*' in FIG. 3A), may be fully opened. The adjustable orifices 109*b-d* not in the open position may remain in the partially open position. With adjustable orifice 109*a*' in the open position, a larger amount of fluid may flow to the corresponding steering blade (103*a*' in FIG. 3B), causing the differential pressure across steering blade 103*a*' to be higher than the differential pressure across the other steering blades 103 and thus exerting a larger extension force, depicted as second extension force F thereupon. The opposing steering blade (here 103*c*) (or steering blades depending on configuration) receives a smaller first extension force f and its smaller extension may substantially correspond to the greater extension of steering blade 103*a*', thereby causing downhole steering tool 100 to be pushed to the side of wellbore 15 in the direction of steering blade 103*a*'. The difference in extension forces may thus cause a change in the direction in which downhole steering tool 100 is pushed relative to wellbore 15, referred to herein as a force-vector direction, which may in turn alter the direction in which wellbore 15 is drilled.

In some embodiments, when drilling a straight or nearly straight wellbore 15, all adjustable orifices 109*a-d* may be opened, applying substantially equal pressure to all steering blades 103, causing equal force exerted by all steering blades 103 against wellbore 15. Alternatively, a gripping force may be exerted by all steering blades 103 against wellbore 15 when all adjustable orifices 109*a-d* are partially open.

Figure 4:
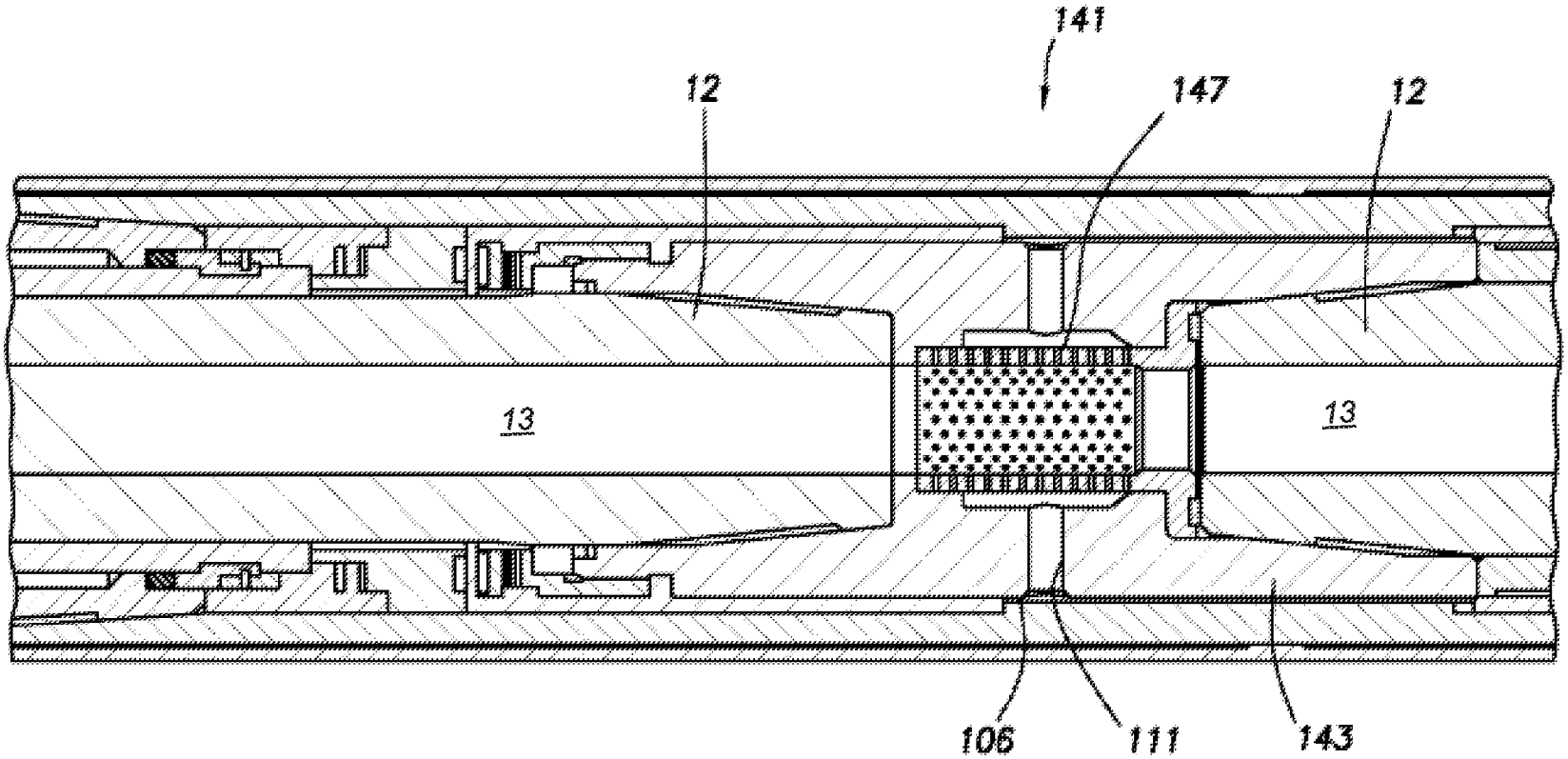
FIG. 4 is a cross section of a diverter of a downhole steering tool consistent with at least one embodiment of the present disclosure.

In some embodiments, as depicted in FIG. 4, fluid may be supplied from the interior of mandrel 12 (shown as having two subcomponents coupled to either side of diverter assembly 141) through a diverter assembly 141. The fluid within mandrel 12 may be supplied by one or more pumps (not shown) at the surface through mandrel 12 to, for example and without limitation, operate one or more downhole tools and clear cuttings from wellbore 15 during a drilling operation. Fluid within mandrel 12 may be at a higher pressure than fluid within wellbore 15. Diverter assembly 141 may include a diverter body 143 coupled to and rotatable with mandrel 12. In some embodiments, diverter assembly 141 may be formed integrally with mandrel 12. In some embodiments, diverter assembly 141 may include a drilling fluid filter 147. Diverter body 143 may include one or more apertures 111 coupling the interior of mandrel 12 to one or more fluid supply ports 106 formed within housing 101. Fluid supply ports 106 may supply fluid to adjustable orifices 109 as described herein below. In some embodiments, approximately 4-5% of the fluid flow through mandrel 12 may be diverted through diverter assembly 141. In some embodiments, a portion of the diverted fluid may pass into one or more bearings (not shown) and may exit to the annular space surrounding downhole steering tool 100.

Referring again to FIG. 1, in some embodiments, downhole steering tool 100 may include differential rotation sensor 112, which may be operable to measure a difference in rotation rates between mandrel 12 and housing 101, and housing rotation measurement device or sensor 116, which may be operable to measure a rotation rate of housing 101. For example, in some embodiments, differential rotation sensor 112 may include one or more infrared sensors, ultrasonic sensors, Hall-effect sensors, fluxgate magnetometers, magneto-resistive magnetic-field sensors, micro-electro-mechanical system (MEMS) magnetometers, and/or pick-up coils. Differential rotation sensor 112 may interact with one or more markers 114, such as infrared reflection mirrors, ultrasonic reflectors, magnetic markers, permanent magnets, or electromagnets, coupled to mandrel 12 which may be, for example and without limitation, one or more magnets or electro-magnets to interact with a magnetic differential rotation sensor 112. Housing rotation measurement device or sensor 116 may include one or more accelerometers, magnetometers, and/or gyroscopic sensors, including micro-electro-mechanical system (MEMS) gyros, MEMS accelerometers, Hall-effect sensors and/or others operable to measure cross-axial acceleration, magnetic-field components, or a combination thereof. Gyroscopic sensors and/or MEMS gyros may be used to measure the rotation speed of housing 101 and irregular rotation speed of housing 101, such as torsional oscillation and stick-slip.

Referring still to FIG. 1, the accelerometers and magnetometers in housing 101 may be used to calculate the toolface of downhole steering tool 100. The toolface of downhole steering tool 100 may, in some embodiments, be referenced to a particular steering blade 103. In some embodiments, the toolface of downhole steering tool 100 may be defined relative to a gravity field, known as a gravity toolface; defined relative to a magnetic field, known as a magnetic toolface; or a combination thereof. Differential rotation sensors 112 and housing rotation measurement device or sensors 116 may be disposed anywhere in the housing 101. Markers 114 may be disposed to the corresponding position on mandrel 12, substantially near differential rotation sensors 112. In some embodiments, a controller (not shown) may control the actuation of adjustable orifices 109. The controller may include one or more microcontrollers, microprocessors, DSP (digital signal processing) chips, FPGAs (field programmable gate arrays), a combination of analog devices, such as analog integrated circuits (ICs), or any other devices known in the art. In some embodiments, as housing 101 rotates, the individual steering blade or blades 103 aligned substantially opposite of the target toolface changes. The controller may be configured to actuate either one or two adjacent steering blades 103 to apply an eccentric steering force on wellbore 15 to push downhole steering tool 100 in a desired direction corresponding with the target toolface. In some embodiments, the steering blades 103 that are not actuated by a controller may be extended to provide gripping pressure as they are in the partially open position.

Pressure data sensors may be installed to measure fluid pressure at various points in the system and environment. Pressure data sensors may comprise transducers or any other device capable of measuring pressure. By way of example only and without limitation, the following fluid pressures may be measured: the annular pressure, internal pressure, ring valve pressure, manifold fluid pressure, compensation fluid pressure, or pad piston pressure. Pad piston pressure may be measured by pressure sensors positioned in one or more of the steering ports 107 and is indicative of the force applied to the respective steering blades 103. In embodiments where pad piston pressure is to be measured, pressure sensors may be positioned so as to measure the fluid pressure in one or more steering ports 107 or adjacent to one or more orifices 109. (such as for three, four, or more pads), etc. By way of example only, suitable miniature pressure data recorders are described in US. Pat. App. 20180066513 "Drilling Dynamics Data Recorder," which includes the pressure transducer and various drilling dynamics sensors. Optionally, these pressure recorders may be connected to the rotary-steerable-system's main controller via communication bus and the main controller may be able to utilize the pressure data to better control the toolface (steering direction) and steer force (dogleg).

The ring valve system has a position sensor and in normal operation, the adjustable orifice positions can be precisely controlled. Due to various circumstances, however, the pressure that is actually applied at each pad face may deviate from the intended pressure. Deviation may be the result of, for example, position sensor drift, misalignment of valve components, or debris in one or more fluid passages, With the aid of pressure transducers installed, for example, in each pad piston, the pad pressures may be fine-regulated to control the toolface and the dogleg, thereby improving control of the wellbore trajectory. The force is the pressure multiplied by the cross-section area of the piston. In this case the cross-section area is constant; therefore, the force is substantially proportional to the pressure applied.

In addition, pressure transducer data from each pad may optionally be used by the RSS main controller/processor to detect or diagnose a valve jam and/or piston jam event. In such cases, the processor may be programmed to perform a pre-programmed jam mitigation algorithm, such as closing the all the orifices and sequentially or simultaneously opening the orifices. By way of example, if a leaky valve is detected, i.e. the valve is closed, but there is still piston pressure, the valve can go through pre-programmed sequences to try to eliminate the cause of the problem. For example, the valve could go shift through each orifice open/closed position.

Another application of pad pressure information is in ring valve telemetry. Optionally, pressure transducer data may be transmitted to the surface via shorthop and MWD mud pulse telemetry. The pressure transducer data may be used as feedback on the generation of intended pressure waveforms, such as sinewave pressure pulses. Control based on the pressure transducer data can be accomplished by adjusting the valve movement velocity based on the measured differential pressure between the valve top and piston pressures. The valve movement velocity can be changed by regulating the electrical motor speed.

In order to generate desired mud pressure changes for signaling, the ring valve may be moved from an all-closed position to an all-open position in which all four pads are activated. The all-closed position generates the highest pressure values (upward telemetry) and the all-open position generates the lowest pressure values. By monitoring the valve top pressure or, alternatively all pad/piston pressures, the valve movement velocity may be precisely controlled to generate an intended mud-pulse waveform.

Optionally, pressure transducer data may be transmitted to the surface via shorthop and MWD mud pulse telemetry. The transmitted pressure data may be used to optimize the operation of the RSS and/or diagnostics of the tool, such as calculating equivalent circulating density, identifying drilling fluid loss, detecting bit nozzle malfunction, etc.

RSS commands or other information may be transmitted from the surface. Optionally, the pressure transducers may be used to detect such flow-rate and/or fluid-pressure modulation downlinks from the surface. For example, the flow rate may be manually changed at the surface based on the coded sequences to give a downlink command or to send a data point to the RSS. In some embodiments, pad pressure data may comprise the received signal; in other embodiments, it may be used in conjunction with one or more second sensors elsewhere in the tool, so as to increase accuracy of a received signal.

Thus, pad pressure data can be used to support various feedback, diagnostic, and sensing steps. By way of example, pad pressure data may be used in a steering feedback step comprising using the ring valve to cause extension of the steering blades by controlling pressure in each steering port and using the pad pressure data as feedback to control the extension of the steering blades. By way of another example, pad pressure data may be used in a signaling feedback step comprising using the ring valve to generate pressure pulse shapes for mud-pulse telemetry and using the pad pressure data as feedback to control the generation of the pressure pulses. By way of another example, pad pressure data may be used a sensing step comprising using the pad pressure data to sense mud pulses arriving at the downhole tool. By way of another example, pad pressure data may be used in a diagnostic step comprising using the pressure data to detect or diagnose a malfunction in the ring valve.

Figure 5:
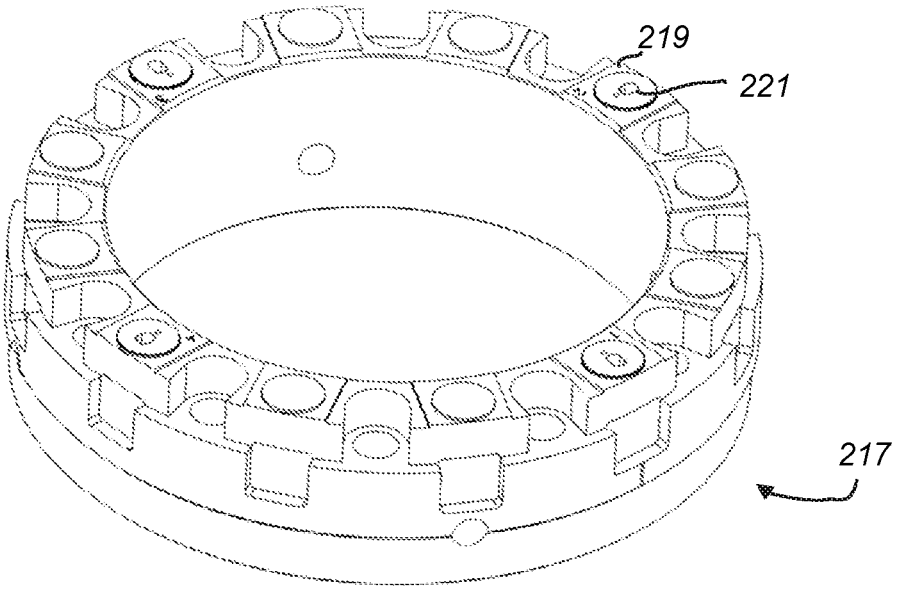
FIG. 5 is an isometric view of a manifold consistent with at least one embodiment of the present disclosure.
Figure 6:
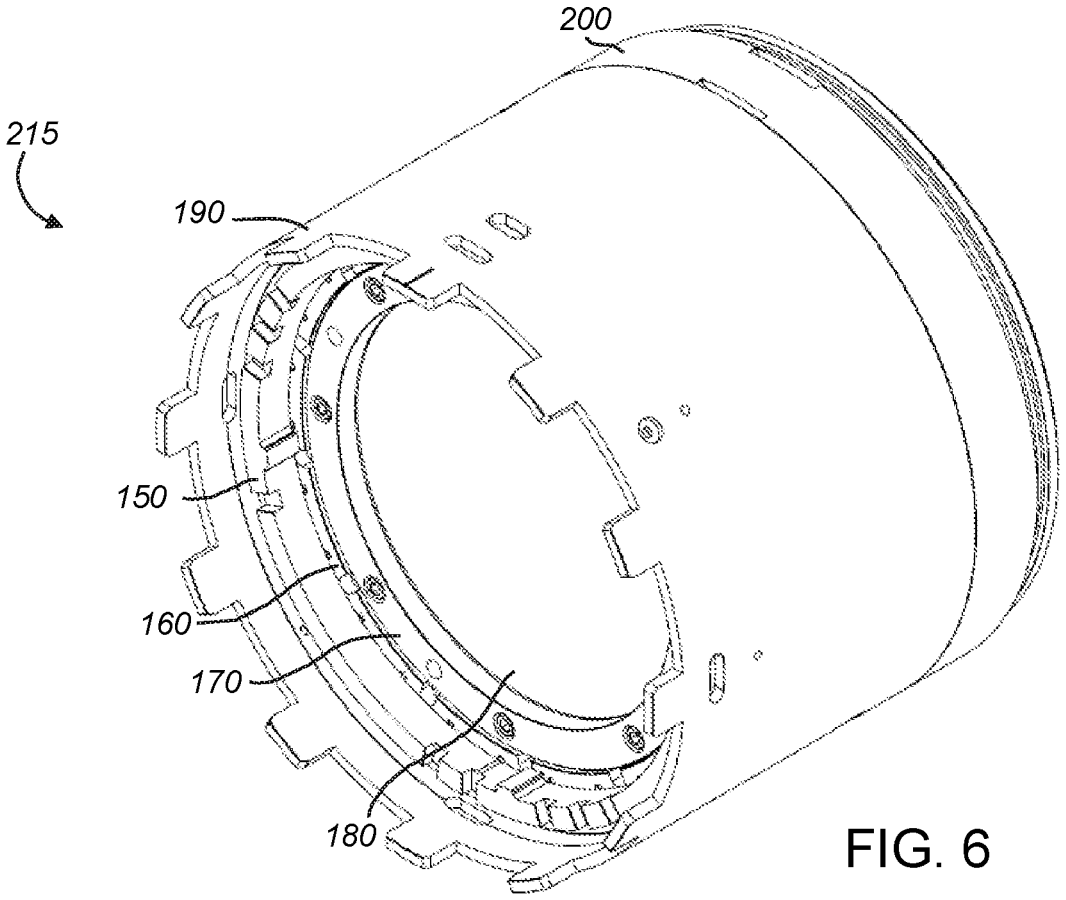
FIG. 6 is an isometric view of a ring valve assembly consistent with at least one embodiment of the present disclosure.

Referring briefly to FIGS. 5 and 6, fluid flow through adjustable orifices 109 may be controlled by a ring valve assembly 215 that works in conjunction with a manifold 217. As described in commonly owned U.S. Pat. No. 10,422,184, which is hereby incorporated by reference in its entirety, manifold 217 may be generally tubular and may include an upper manifold surface 219. Upper manifold surface 219 may be continuous or may include one or more cutouts as shown. Manifold 217 may include a plurality of manifold orifice sets 221 arranged about upper manifold surface 219. In some embodiments, each manifold orifice set 221 may be fluidly coupled to a single adjustable orifice 109. Each manifold orifice set 221 may also be fluidly coupled to a corresponding steering port 107. Each manifold orifice set 221 may include two or more orifices, which may include one or more steering manifold orifices and one or more gripping manifold orifices. In operation, the orifices may be selectively exposed to fluid flow by adjusting ring valve assembly 215.

Figure 7:
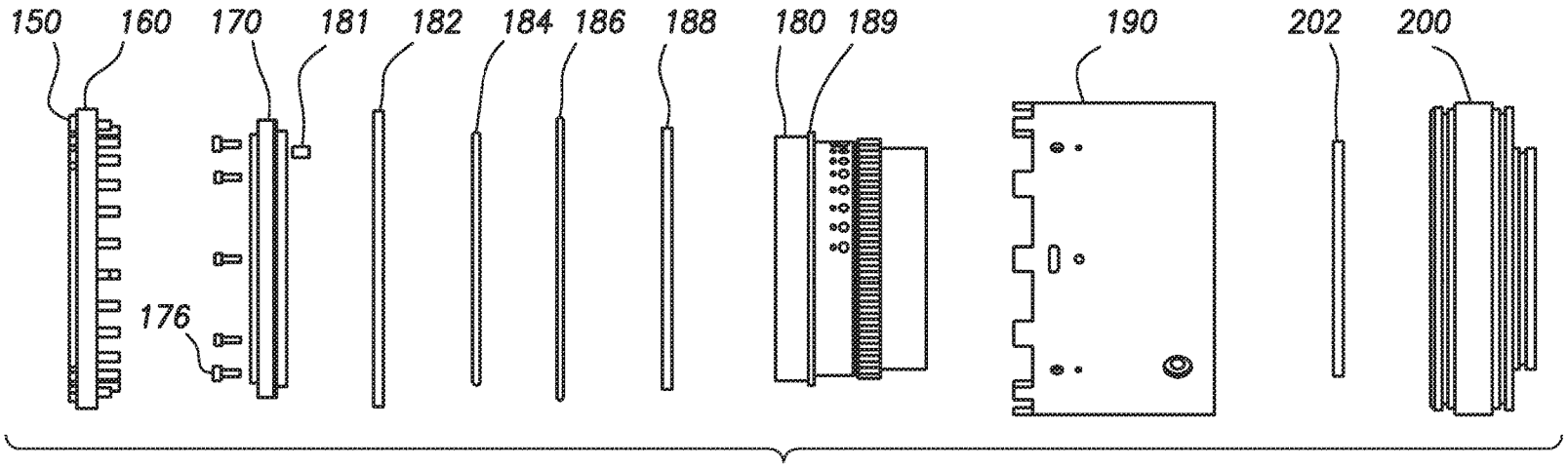
FIGS. 7-8 are exploded side views of the ring valve assembly of FIG. 6.
Figure 8:
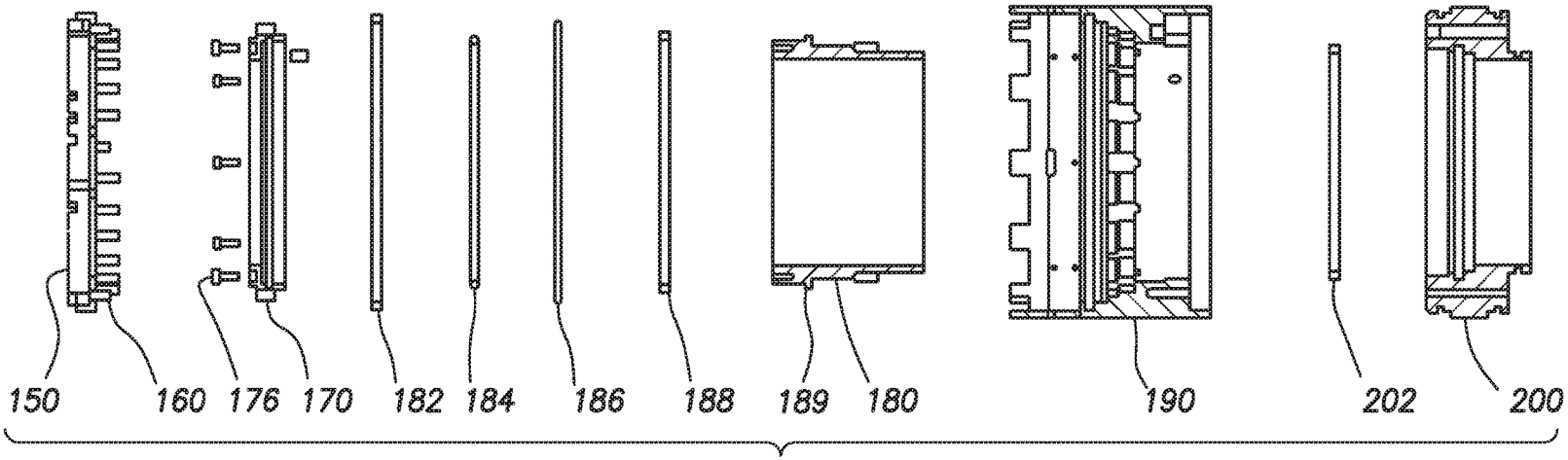
Figure 9:
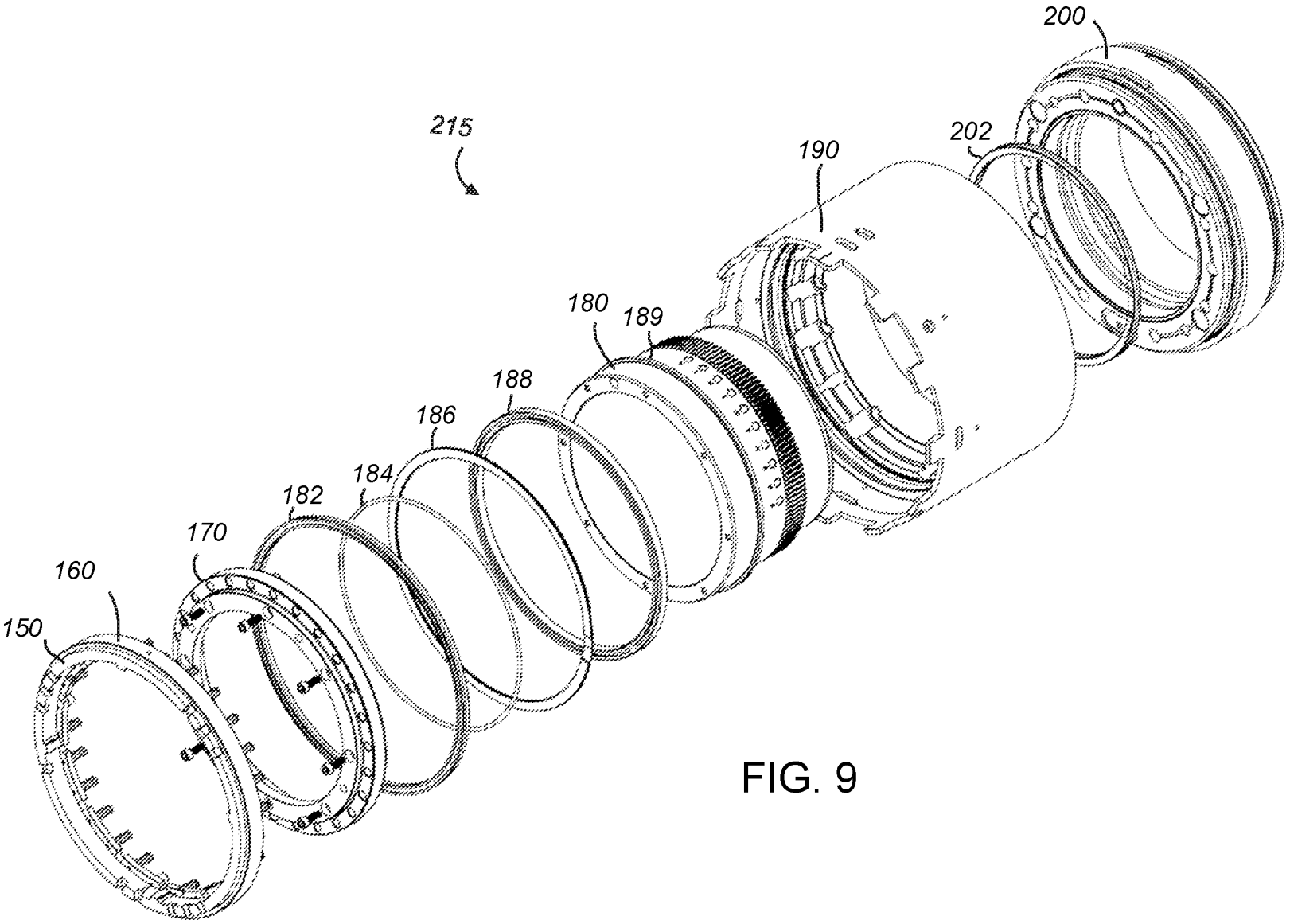
FIG. 9 is an isometric exploded view of the ring valve assembly of FIG. 6.

Referring now to FIGS. 7-9, ring valve assembly 215 may include a valve seat 150, valve carrier 160, lower valve housing 170, upper valve housing 180, alignment pin 181, gear housing 190, shaft housing assembly 200, and seal 202. In some embodiments, valve seat 150 may be made of a durable material such as a carbide, including but not limited to tungsten carbide, titanium carbide, ceramics, and synthetic diamond. Upper valve housing 180 may include an external shoulder 189. A second seal 182, O-ring 184, snap ring 186, and bidirectional thrust bearing 188 may be positioned between lower valve housing 170 and upper valve housing 180. Snap ring 186 may retain thrust bearing 188 in a desired position by engaging shoulder 189 on upper valve housing 180.

Figure 10:
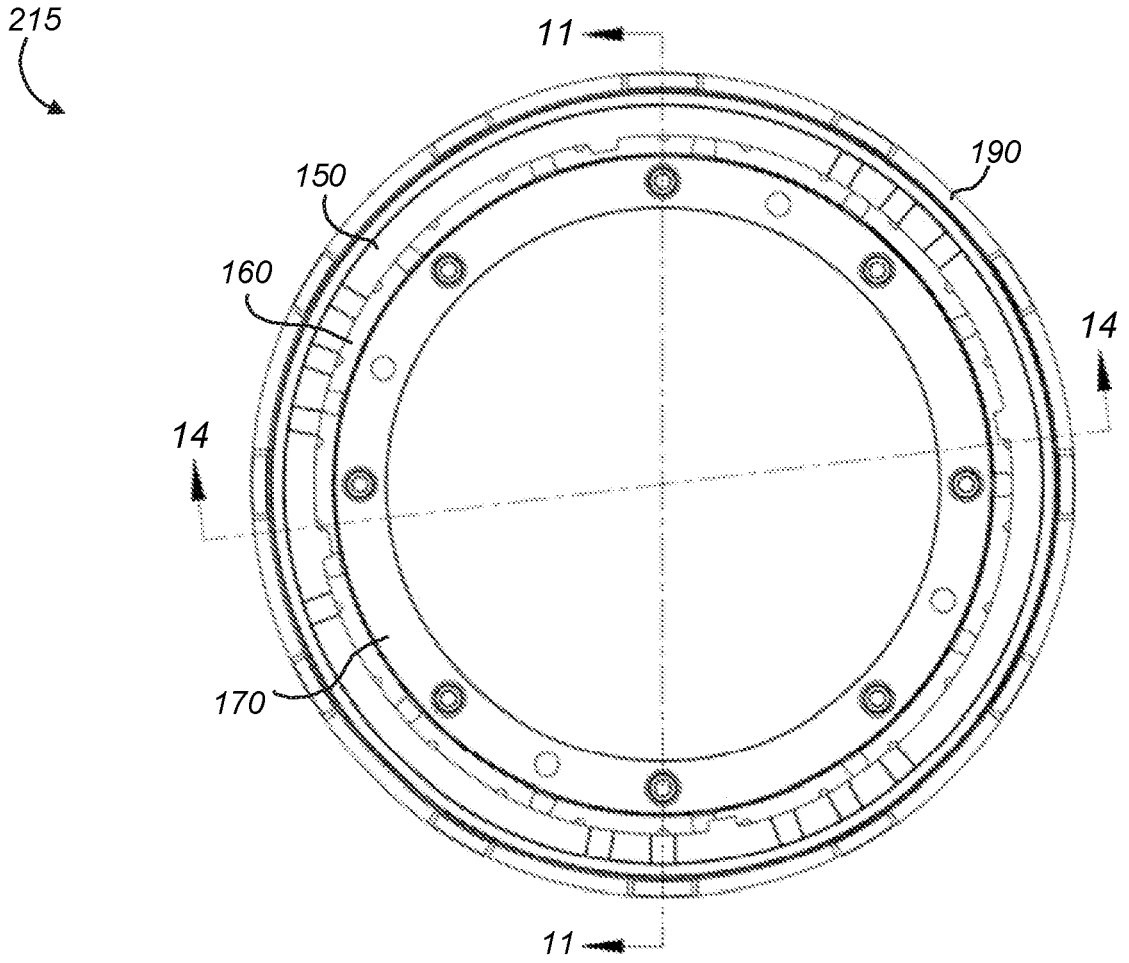
FIG. 10 is an end view of the ring valve assembly of FIG. 6.

As best illustrated in FIGS. 6, 9 and 10, valve seat 150, valve carrier 160, lower valve housing 170, second seal 182, O-ring 184, snap ring 186, and thrust bearing 188, upper valve housing 180, shaft housing assembly 200, and seal 202 may be concentrically arranged and received in gear housing 190 so as to form ring valve assembly 215.

It may be desirable to maintain alignment and a tight clearance between upper valve housing 180 and gear housing 190. In some embodiments, the components may be bolted together. In addition, it may be desirable to transfer load from lower valve housing 170 to upper valve housing 180 via thrust bearing 188.

Figures 11, 12, 13:
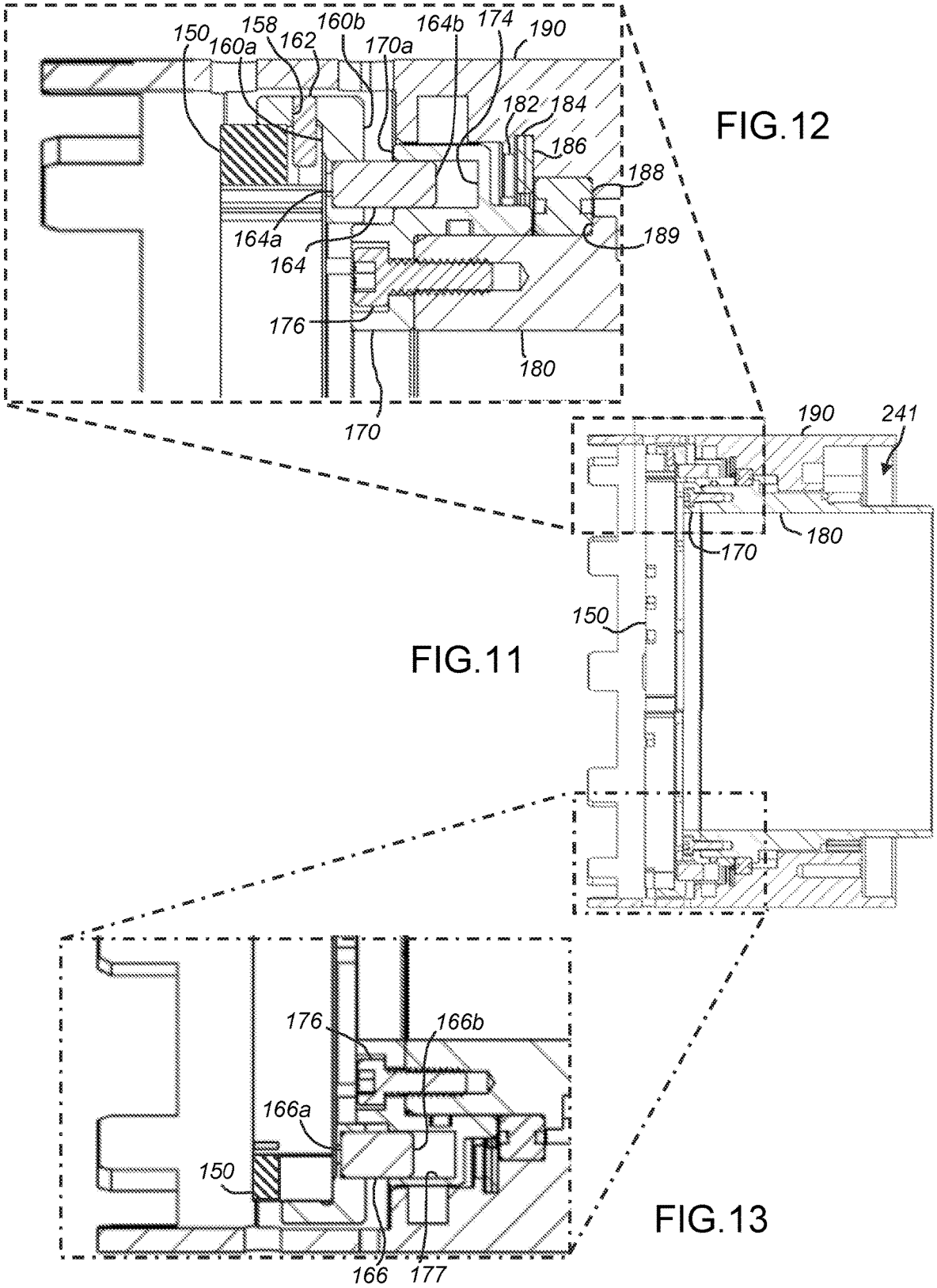
FIG. 11 is a cross section along lines 11-11 of FIG. 10.
FIGS. 12-13 are enlarged views of portions of FIG. 11.

Referring now to FIG. 12, valve carrier 160 may have upper and lower surfaces **160*b*, 160*a*, respectively. Valve carrier 160 may be mechanically coupled to valve seat 150 by one or more coupling pins 162, which may extend radially through an opening 158 in a side wall of valve carrier 160 into valve seat 150. Valve seat 150 may be interference shrink fit into valve carrier 160. Coupling pin 162 serves to retain valve seat 150 in proper alignment during the shrink fit process. Lower valve carrier surface 160*a* may be configured to support valve seat 150 around the full circumference of valve seat 150**.

In some embodiments, lower valve housing 170 may include a lower surface, hereinafter referred to as biasing surface **170*a*. A timing pin 164 may mechanically engage both valve carrier 160 and lower valve housing 170. Timing pin 164 may be substantially longitudinal. Lower end 164*a* of timing pin 164 may be received in and/or affixed substantially permanently to valve carrier 160. The opposite end, upper end 164*b*, of timing pin 164 may be slidably received in a corresponding receptacle 174 in biasing surface 170*a* of lower valve housing 170. Receptacle 174 may be sized such that some longitudinal movement of timing pin 164 is possible. In these embodiments, valve carrier 160 can move longitudinally with respect to lower valve housing 170** but is prevented from rotating or moving laterally relative thereto.

Also as shown in FIGS. 12 and 13, one or more fasteners 176 may be used to rigidly couple lower valve housing 170 to upper valve housing 180 and capturing second seal 182, O-ring 184, snap ring 186, and bidirectional thrust bearing 188 therebetween. Each fastener 176 may comprise a screw or other suitable device. Fasteners 176 are preferably removeable so as to allow disassembly of ring valve assembly 215. In some embodiments, there may be a plurality of fasteners 176; in the illustrated embodiment, eight fasteners 176 are used. Other numbers of fasteners may be provided in other embodiments.

Referring now to FIG. 13, one or more containment pins 166 may also extend between valve carrier 160 and lower valve housing 170. The lower end **166*a* of each containment pin 166 may be received in and/or affixed substantially permanently to valve carrier 160. The upper end 166*b* of each containment pin 166 may be slidably received in a corresponding receptacle 177 in lower valve housing 170. Timing pin 164 ensures proper alignment of the valve with the manifold (FIG. 5). Containment pins 166 ensure proper alignment and reduce radial movement in the valve. In some embodiments, there may be a plurality of containment pins 166; in the illustrated embodiment, four containment pins 166** are used. The use of multiple containment pins reduces likelihood of jamming under misalignment.

Figure 15:
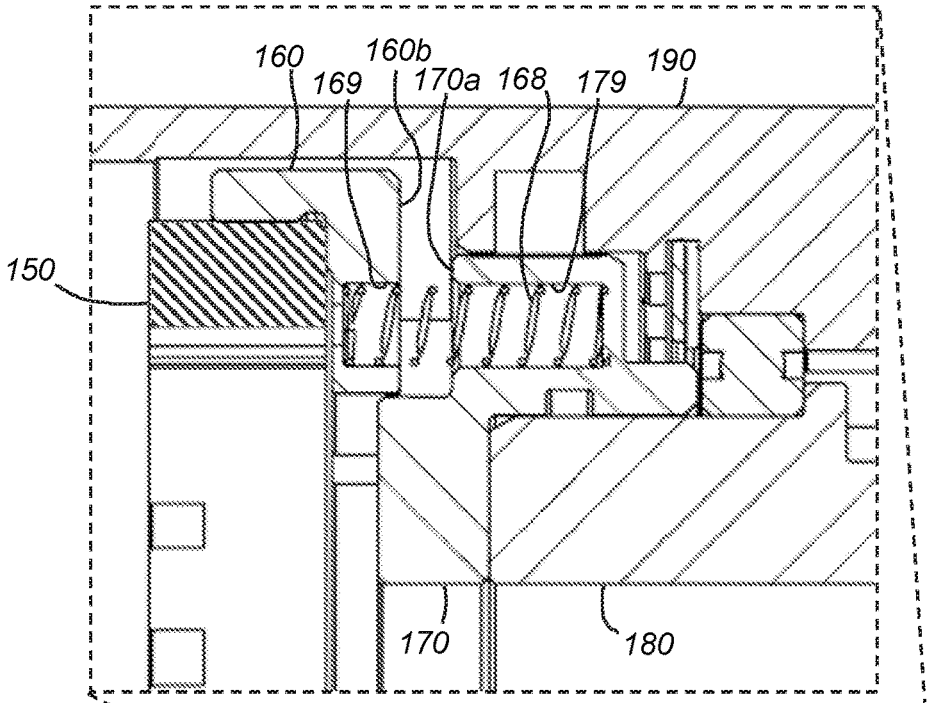
FIG. 15 is an enlarged view of a portion of FIG. 14.
Figure 14:
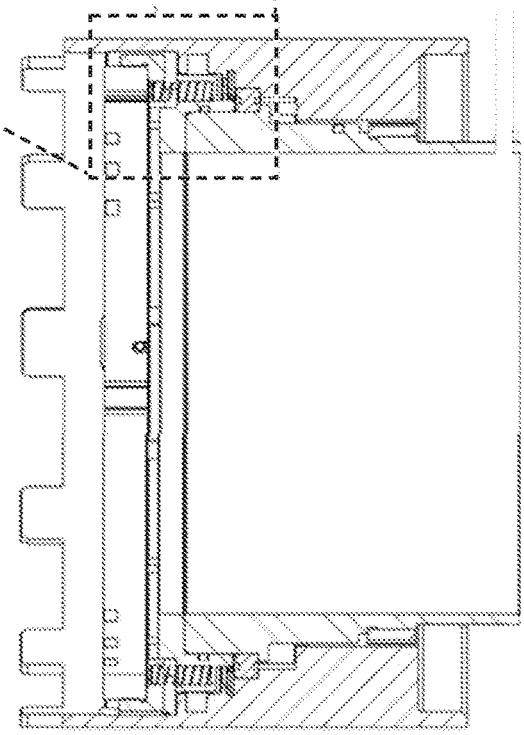
FIG. 14 is a cross section along lines 14-14 of FIG. 10.

Referring now to FIGS. 14-15, in some embodiments, one or more biasing means 168 may also be included between valve carrier 160 and lower valve housing 170. Biasing means 168 serves to urge valve carrier 160 and lower valve housing 170 apart. To that end, biasing means 168 may comprise any device capable of elastic deformation upon compression, including but not limited to coil springs, Belleville washers, elastomeric members, and leaf or bow springs. In some embodiments, a first end of each biasing means 168 may be received in a corresponding receptacle 169 in valve carrier 160 and/or affixed substantially permanently affixed thereto and a second end of each biasing means 168 may be received in a corresponding receptacle 179 in lower valve housing 170.

Receptacles 177 and 179 in lower valve housing 170 may be identical, and each may be capable of receiving either a containment pin 166 or a biasing means 168. In some embodiments, there may be a plurality of containment pins 166 and biasing means 168; in the illustrated embodiment, lower valve housing 170 includes sixteen receptacles evenly spaced about biasing surface 170*a* and four containment pins 166 and twelve biasing means 168 are received therein. The number and relative proportion of containment pins 166 and biasing means 168 can be varied as desired and is limited only by the number of receptacles provided. In embodiments having more than one biasing means 168, the biasing means may be evenly spaced about the circumference of the tool. Containment pins 166 ensure that the center line of the ring valve is always aligned with the centerline of the manifold. In addition, containment pins 166 ensures that the ring valve surface and the manifold surface are parallel. The biasing means 168 maintains contact between these two surfaces.

Together, containment pins 166 and biasing means 168 provide a balanced and distributed force urging valve carrier 160 away from lower valve housing 170. The force on valve carrier 160 ensures that fluid channels through ring valve assembly 215 will remain closed when desired. One advantage of the energized valve is that when it is operated at a pressure drop less than the desired pressure drop (e.g. 400 psi, instead of the recommended 600 psi), the valve still activates the proper pad(s)/blade(s). The present device ensures that the valve is pressed against the manifold surface, avoiding unintended or undesirable pad activation. The present device also provides consistent operation even when inclined or influenced by downhole dynamics; the valve remains pressed against the manifold, ensuring the proper activation of the desired pad(s).

Because of the movement allowed between valve carrier 160 and lower valve housing 170, lower valve housing 170, second seal 182, O-ring 184, snap ring 186, thrust bearing 188, and upper valve housing 180 can be securely coupled and sealed together and that tolerances between upper valve housing 180 and gear housing 190 can be tightened. By way of example, the components can be machined to fit and/or shimmed to fit.

Figure 16:
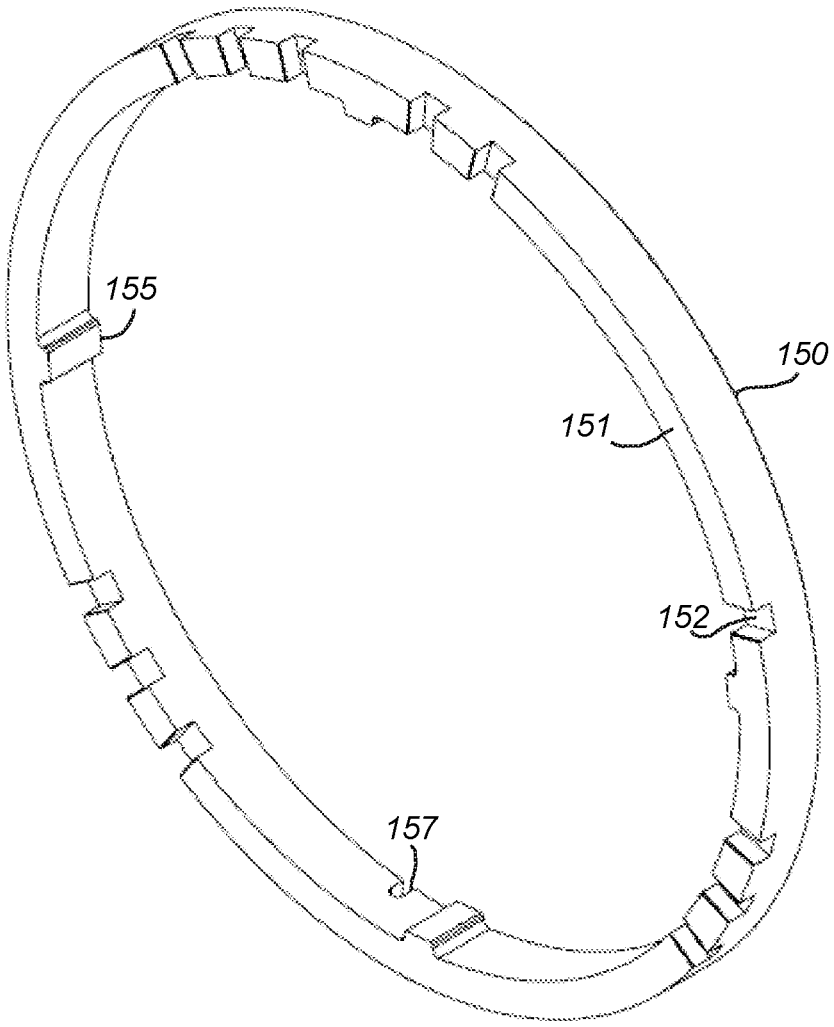
FIG. 16 is an enlarged view of a valve seat consistent with at least one embodiment of the present disclosure.

Referring briefly to FIG. 16, in some embodiments, valve seat 150 may include a lower ring surface 151 that includes one or more radial slots 152. The inner surface of valve seat 150 may also include one or more inwardly-extending bosses 155 and the upper surface of valve seat 150 may include a notch 157. Bosses 155 cut off drilling fluid to the control pads when they are positioned over the manifold ports, thereby allowing the tool to have an "all closed" position. Notch 157 receives coupling pin 162 during the shrink fit process. This ensures proper alignment of the valve.

When the tool is fully assembled, lower ring surface 151 may abut upper manifold surface 219 such that when a slot 152 is aligned with one or more orifices of a manifold orifice set 221, fluid can flow through the aligned orifices from a fluid supply port 106 coupled to the interior of mandrel 12 as previously discussed. In some embodiments, slots 152 may be arranged such that valve seat 150 needs only rotate a partial turn to actuate adjustable orifices 109. In some embodiments, slots 152 may be arranged about valve seat 150 such that adjustable orifices 109 opposite one another are not open at the same time. In some embodiments, slots 152 may be arranged such that adjacent adjustable orifices 109 may be opened at the same time. Thus, ring valve assembly 215 may be used to control the flow of any fluid that flows through mandrel 12.

Ring valve assembly 215 may be actuated by a motor and pinion, which engage the back of gear housing 190, indicated generally at 241. The motor and pinion may be controlled by a controller (not shown) so as to move slots 152 into and out of alignment with manifold orifice sets 221. In some embodiments, valve seat 150 may be rotatable by one or more full revolutions. The controller may include, for example and without limitation, one or more microcontrollers, microprocessors, DSP (digital signal processing) chips, FPGAs (field programmable gate arrays), a combination of analog devices, such analog integrated circuits (ICs), or any other devices known in the art, which may be programmed with motor controller logic and algorithms, including angular position controller logic and algorithms.

As the ring valve assembly 215 is actuated in and out of its various open positions, biasing means 168 applies a constant and distributed load to valve carrier 160 and thereby serves to maintain contact between valve seat 150, which is seated on valve carrier 160, and manifold 217. This in turn maintains the desired fluid flow path through the tool.

In some embodiments, downhole steering tool 100 may transmit data to the surface. In some embodiments, for example and without limitation, a series of pressure pulses may be utilized to transmit communication signals. The pressure pulses may be generated by the opening and closing of one or more steering ports 107 by ring valve assembly 215.

In some embodiments, the pressure pulses may be utilized to transmit a binary signal. In some embodiments, Manchester encoding may be utilized to transmit data to the surface, including but not limited to inclination, azimuth, housing gravity/magnetic toolface, target toolface, actual toolface, housing rotation speed, bit rotation speed, shock/vibration severities, stick-slip severities, high-frequency-torsional-oscillation (HFTO) severities, temperatures, pressure, other diagnostic information, and so on. An advantage of the present device is that it makes the pressure pulse signal magnitude consistent and reliable by maintaining the desired fluid flow path through the tool.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art will also understand that such equivalent constructions do not depart from the scope of the present disclosure and that they may make various changes, substitutions, and alterations to the devices disclosed herein without departing from the scope of the present disclosure.

What is claimed is:

1. A steering tool for use in a wellbore, comprising:

a tool housing coupled to and positioned about a tubular mandrel having a bore therethrough, the tool housing able to rotate about the mandrel;

a steering cylinder formed in the housing, wherein the steering cylinder is fluidly coupled to a first steering port and contains fluid at a steering cylinder pressure;

a steering blade coupled to the housing, the steering blade at least partially positioned within the steering cylinder, the steering blade extendable by an extension force to contact a wellbore, wherein the extension force is caused by a differential pressure between the steering cylinder pressure and a fluid pressure in the wellbore; and a ring valve, the ring valve including:

a gear housing;

a manifold mechanically coupled to the tool housing, wherein the manifold includes an upper manifold surface having at least one manifold orifice therein, wherein the manifold orifice provides fluid communication between the upper manifold surface and the first steering port and fluidly couples the bore to the steering cylinder;

a valve seat, the valve seat having a lower ring surface positioned in abutment with the upper manifold surface, wherein the valve seat is rotatable relative to the manifold, and wherein the lower ring surface is configured such that rotation of the valve seat relative to the manifold selectively opens and closes the at least one manifold orifice;

a valve carrier mechanically coupled to the valve seat and having upper and lower valve carrier surfaces, wherein the lower valve carrier surface circumferentially supports the valve seat;

an upper valve housing mechanically coupled to the gear housing;

a lower valve housing mechanically coupled to the upper valve housing and reciprocably coupled to the valve carrier; and at least one biasing means positioned between the valve carrier and the lower valve housing and configured to urge the valve carrier away from the lower valve housing.

2. The steering tool according to claim 1 wherein the valve carrier has an upper valve carrier surface and the lower valve housing has a biasing surface configured to bear on the upper valve carrier surface, and wherein the biasing surface includes at least two receptacles each configured to receive a biasing means.

3. The steering tool according to claim 2 wherein the biasing surface includes at least sixteen receptacles, wherein the tool includes twelve biasing means each partially received in a receptacle and positioned between the valve carrier and the lower valve housing.

4. The steering tool according to claim 3 wherein the tool further includes four containment pins each partially received in a receptacle and positioned between the valve carrier and the lower valve housing.

5. The steering tool according to claim 2 wherein the receptacles are evenly spaced about the circumference of the steering tool.

6. The steering tool according to claim 1 wherein each biasing means is selected from the group consisting of: coil springs, Belleville washers, elastomeric members, and leaf or bow springs.

7. The steering tool according to claim 1, further including a seal, an O-ring, a snap ring, and a thrust bearing between the lower valve housing and the upper valve housing.

8. The steering tool according to claim 1, further including at least one pressure sensor in the steering port.

9. The steering tool according to claim 1, further including a plurality of steering ports formed in the housing, wherein each steering ports includes a pressure sensor.

10. A downhole steering tool comprising:

a housing coupled to and positioned about a tubular mandrel, the housing able to rotate about the mandrel, the housing having a steering cylinder formed therein, the steering cylinder fluidly coupled to a steering port;

a steering blade coupled to the housing, the steering blade at least partially positioned within the steering cylinder, the steering blade extendable by an extension force to contact a wellbore, the extension force caused by a differential pressure between a steering cylinder pressure and a pressure in the wellbore surrounding the downhole tool, the differential pressure caused by fluid pressure of a fluid within the steering cylinder;

a pressure sensor in the steering port, and a ring valve, the ring valve including:

a gear housing;

a manifold mechanically coupled to the tool housing, wherein the manifold includes an upper manifold surface having at least one manifold orifice therein, wherein the manifold orifice provides fluid communication between the upper manifold surface and steering port so as to fluidly couple the bore to the steering cylinder;

a valve seat, the valve seat having a lower ring surface positioned in abutment with the upper manifold surface, wherein the valve seat is rotatable relative to the manifold, and wherein the lower ring surface is configured such that rotation of the valve seat relative to the manifold selectively opens and closes the at least one manifold orifice;

a valve carrier mechanically coupled to the valve seat and having upper and lower valve carrier surfaces, wherein the lower valve carrier surface circumferentially supports the valve seat;

an upper valve housing mechanically coupled to the gear housing; and a lower valve housing mechanically coupled to the upper valve housing and reciprocably coupled to the valve carrier.

11. A method for drilling a well, comprising the steps of:

a) providing a drill string that includes a downhole steering tool, the downhole steering tool comprising:

a housing coupled to and positioned about a tubular mandrel, the housing able to rotate about the mandrel, the housing having a plurality of steering cylinders formed therein, each steering cylinder fluidly coupled to a respective steering port;

a plurality of steering blades coupled to the housing, each steering blade at least partially disposed within a respective steering cylinder, each steering blade extendable by a differential pressure between a respective steering cylinder pressure and a pressure in the wellbore surrounding the downhole tool, the differential pressure caused by fluid pressure in a respective steering port;

a pressure sensor in at least one steering port, and a ring valve, the ring valve including:

a gear housing;

a manifold mechanically coupled to the tool housing, wherein the manifold includes an upper manifold surface having at least one manifold orifice therein, wherein the manifold orifice provides fluid communication between the upper manifold surface and steering port so as to fluidly couple the bore to the steering cylinder;

a valve seat, the valve seat having a lower ring surface positioned in abutment with the upper manifold surface, wherein the valve seat is rotatable relative to the manifold, and wherein the lower ring surface is configured such that rotation of the valve seat relative to the manifold selectively opens and closes the at least one manifold orifice;

a valve carrier mechanically coupled to the valve seat and having upper and lower valve carrier surfaces, wherein the lower valve carrier surface circumferentially supports the valve seat;

an upper valve housing mechanically coupled to the gear housing; and a lower valve housing mechanically coupled to the upper valve housing and reciprocably coupled to the valve carrier;

b) using the downhole steering tool to steer while drilling; and c) using the pressure sensor to measure pressure in the steering port and using the measured pressure to adjust operation of the downhole steering tool.

12. The method of claim 11 wherein the downhole steering tool includes a pressure sensor in each steering port, further including the steps of d) using the ring valve to cause extension of the steering blades by controlling pressure in each steering port; and e) using the pressure measured in step c) as feedback to control the extension of the steering blades in step d).

13. The method of claim 11, further including the steps of d) using the ring valve to generate pressure pulse shapes for mud-pulse telemetry; and e) using the pressure data measured in step c) as feedback to control the generation of pressure pulses in step d).

14. The method of claim 11, further including the steps of d) using the pressure data measured in step c) to sense mud pulses arriving at the downhole tool.

15. The method of claim 11, further including the steps of d) using the pressure data measured in step c) to detect or diagnose a malfunction in the ring valve.

16. The method of claim 11 wherein the ring valve further includes at least one biasing means positioned between the valve carrier and the lower valve housing and configured to urge the valve carrier away from the lower valve housing, and wherein the downhole steering tool includes a pressure sensor in each steering port, further including using the pressure measured in step c) to execute at least two of:

i) a steering feedback step comprising:

ia) using the ring valve to cause extension of the steering blades by controlling pressure in each steering port; and ib) using the pressure measured in step c) as feedback to control the extension of the steering blades in step ia);

ii) a signaling feedback step comprising:

iia) using the ring valve to generate pressure pulse shapes for mud-pulse telemetry; and iib) using the pressure data measured in step c) as feedback to control the generation of pressure pulses in step iia); and iii) a sensing step comprising:

using the pressure data measured in step c) to sense mud pulses arriving at the downhole tool;

iv) a diagnostic step comprising:

using the pressure data measured in step c) to detect or diagnose a malfunction in the ring valve.

17. The method of claim 16 wherein each of steps i), ii), iii) and iv) is carried out at least once during a single drilling operation.

18. The method of claim 16 wherein step ib) comprises adjusting the position of the valve seat relative to the manifold so as to adjust a fluid flow through at least one manifold orifice.

19. The method of claim 16 wherein step iib) comprises changing the valve movement velocity.

20. The method of claim 16 wherein step iv) triggers a jam mitigation step in which the ring valve opens and closes at least one manifold orifice.

* * * * *